United States Patent [19]

Röck et al.

[11] Patent Number: 4,583,261

[45] Date of Patent: Apr. 22, 1986

[54] HINGE ASSEMBLY FOR CONNECTING A DOOR TO A FRAME OF A FURNITURE BODY

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 438,367

[22] Filed: Oct. 20, 1982

[30] Foreign Application Priority Data

Nov. 10, 1981 [AT] Austria ..... 4821/81

[51] Int. Cl.[4] ..... E05D 7/04

[52] U.S. Cl. ..... 16/238; 16/272; 16/257; 16/382

[58] Field of Search ..... 16/252, 257, 260, 261, 16/262, 270, 271, 272, 382, 387, DIG. 43, DIG. 40, DIG. 36, 378, 379, 238, 245, 246, 364, 237; 403/331, 381

[56] References Cited

U.S. PATENT DOCUMENTS

| | | | |
|---|---|---|---|
| 1,150,125 | 8/1915 | King | 403/146 |
| 3,781,944 | 1/1974 | Gianardi | 16/252 |
| 3,909,879 | 10/1975 | Grunert et al. | 16/245 |
| 3,965,530 | 6/1976 | Rock et al. | 16/237 |
| 4,386,449 | 6/1983 | Brustle et al. | 16/379 X |

FOREIGN PATENT DOCUMENTS

| | | | |
|---|---|---|---|
| 353133 | 10/1979 | Austria . | |
| 2638585 | 3/1978 | Fed. Rep. of Germany | 16/382 |

*Primary Examiner*—Donald R. Schran
*Assistant Examiner*—James L. Wolfe
*Attorney, Agent, or Firm*—Wenderoth, Lind & Ponack

[57] ABSTRACT

A hinge is mountable on the frame of a cabinet and includes a base plate, an intermediate part and a hinge arm. The intermediate part is held in slide grooves in the base plate, and the intermediate part and the hinge arm are held together by a screw.

4 Claims, 3 Drawing Figures

HINGE ASSEMBLY FOR CONNECTING A DOOR TO A FRAME OF A FURNITURE BODY

BACKGROUND OF THE INVENTION

1. Field of the Invention

The invention relates to a hinge including an intermediate part for quick connection between a door and a frame of a furniture body, a hinge casing insertable into a bore in the door and a mounting body fastenable to the frame and carrying a hinge arm by means of the intermediate part, the hinge arm and the intermediate part being held by a screw and the hinge arm being connected with the hinge casing by means of a hinge axle or by means of hinge axles and hinge links.

Furniture hinges of this kind are used with furniture bodies which have side walls that are so thin that they cannot carry the load of the door and that, hence, include a separate frame carrying the door.

2. Summary of the Invention

It is the object of the invention to provide a hinge of this kind in which the hinge arm with the intermediate part can be quickly positioned on the mounting body and easily fastened thereto, when final mounting operations are carried out.

According to the invention, this is achieved by adapting the intermediate part to engage in grooves in the mounting body and by clamping holding projections of the mounting body between the hinge arm and the intermediate part by means of the screw.

The advantage that the holding projections of the mounting body are clamped between the hinge arm and the intermediate part has the effect that the holding projections are not exposed to loads, such as is the case with prior art hinges in which the intermediate part is by means of a screw pressed away from the bottom of the mounting body towards the holding projections. Furthermore, prior art hinges require a screw for holding the intermediate part at the mounting body and a second screw for holding the hinge arm at the intermediate flange.

An advantageous embodiment of the invention provides that a spring is arranged between the intermediate part and the hinge arm. The spring is advantageously a pressure spring extending around the screw. The advantage of the spring is that the intermediate part and the hinge arm are spaced from each other before being mounted so that this unit can easily be placed on the mounting body.

A further embodiment of the invention provides that the holding projections of the mounting body are clamped between noses or flanges of the intermediate part and the side flanges or walls of the hinge arm which has a shaped U-profile.

BRIEF DESCRIPTION OF THE DRAWINGS

In the following an embodiment of the invention will be described in greater detail and with reference to the accompanying drawings, wherein: without being limited thereto.

DESCRIPTION OF THE PREFERRED EMBODIMENT

Figure 1:
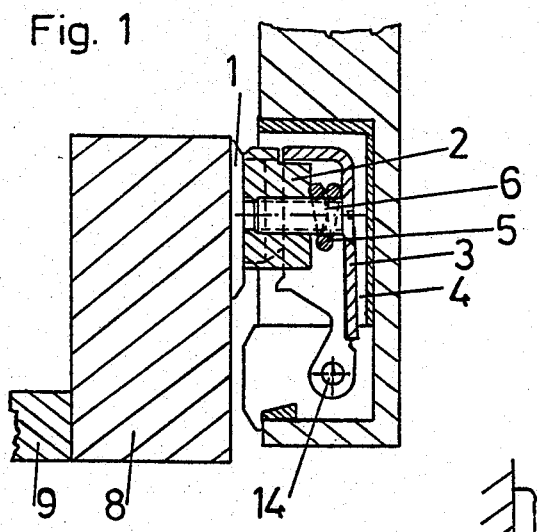
FIG. 1 is a horizontal sectional view of a hinge according to the invention.

A mounting body 1 is fastened to a frame 8 by means of screws or dowels in a conventional manner.

The mounting body 1 is provided with holding projections 10 delimiting grooves 11. An intermediate part 2 is inserted into grooves 11 and held therein by noses or flanges 12.

The intermediate part 2 has a female thread into which a screw 4 is screwed.

Figure 2:
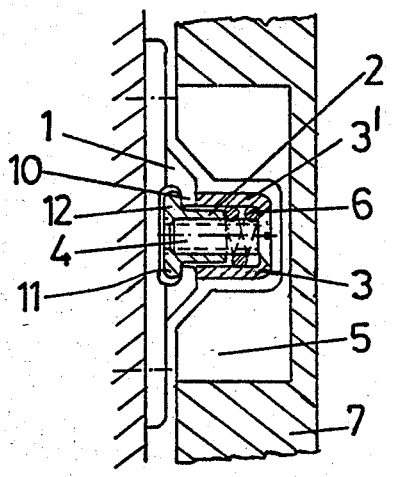
FIG. 2 is a vertical sectional view of the hinge according to the invention.
Figure 3:
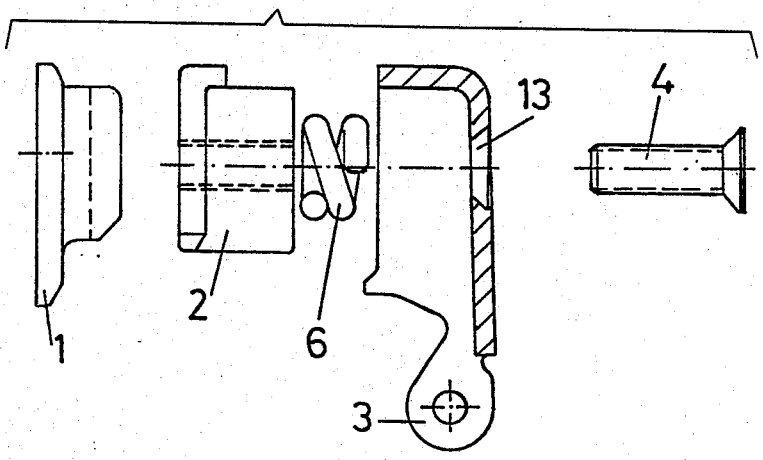
FIG. 3 is an exploded view, partially in section, of the parts of the hinge the parts being shown apart partly in section.

A hinge arm 3 is mounted on the intermediate part 2, i.e. it is held by means of the screw 4 extending through a hole 13 in the hinge arm. Lateral flanges or walls 3' of the hinge arm 3, which has a U-profile as can particularly be seen in FIG. 2, together with the noses 12 of the intermediate part 2 clamp the holding projections 10 of the mounting body when the screw 4 is tightened.

The hinge arm 3 is pivotally connected with a hinge casing 5 by means of a hinge axle 14.

If, in the illustrated embodiment, the holding projections 10 and the grooves 11 are horizontally aligned, an adjustment of a door 7 in the direction of the breadth of the door joint is possible by displacing the hinge arm 3 and the intermediate part 2 with respect to and along the mounting body 1.

In order to facilitate positioning of the unit comprising hinge arm 3 and intermediate part 2, a coil spring 6 is arranged between the intermediate part 2 and the hinge arm 3, the coil spring being positioned around the screw 4.

What is claimed is:

1. A hinge assembly for connecting a door to a frame of a furniture body, said hinge assembly comprising:

a hinge casing adapted to be inserted into a bore of a furniture door;

a hinge arm having a U-shaped profile and including a pair of spaced walls;

means for pivotally connecting said hinge arm to said hinge casing;

a mounting body adapted to be mounted on a furniture frame, said mounting body having extending therefrom projections defining with said body respective grooves;

an intermediate part separate from said hinge arm and having extending therefrom flanges slidably fittable into respective said grooves, whereby said intermediate part is adjustably mountable on said mounting body;

screw means for connecting said hinge arm to said intermediate part and for clamping said projections between said flanges of said intermediate part and said walls of said hinge arm; and spring means positioned for urging said hinge arm away from said intermediate part upon loosening of said screw means to allow movement of said flanges within said grooves.

2. An assembly as claimed in claim 1, wherein said screw means comprises a single screw extending through a hole in said hinge arm and adjustably threaded into said intermediate part.

3. An assembly as claimed in claim 2, wherein said spring means comprises a coil spring positioned between said hinge arm and said intermediate part and through which extends said single screw.

4. An assembly as claimed in claim 1, wherein said projections comprise two projections extending inwardly toward each other, and said flanges comprise two flanges extending outwardly away from each other.

* * * * *